US005231250A

United States Patent [19]

Moulton

[11] Patent Number: 5,231,250

[45] Date of Patent: Jul. 27, 1993

[54] WEATHERPROOF ELECTRODE SPLICE CAP FOR NEON SIGN SYSTEMS

[76] Inventor: Herbert F. Moulton, 4524 W. Marlette, Glendale, Ariz. 85301

[21] Appl. No.: 516,170

[22] Filed: Apr. 30, 1990

[51] Int. Cl.[5] ..... H01B 17/00

[52] U.S. Cl. ..... 174/138 F; 174/5 R:74 A; 174/138 H; 439/230; 439/367; 439/892

[58] Field of Search ..... 174/5 R, 74 A, 77 S, 174/138 F, 138 H; 40/545; 248/50; 439/125, 230, 367, 445, 447, 519, 521, 588, 750, 892

[56] References Cited

U.S. PATENT DOCUMENTS 2,468,226 4/1949 Murphy ..... 174/77 S X
2,904,769 9/1959 Sampson et al. ..... 174/77 S X
3,113,997 12/1963 Schneiderman et al. ..... 174/138 F
3,431,534 3/1969 Schrader et al. ..... 439/125
4,702,710 10/1987 Dittman et al. ..... 439/125 X

FOREIGN PATENT DOCUMENTS 1000863 10/1951 France ..... 174/138 F
344461 3/1960 Switzerland ..... 174/74 A

*Primary Examiner*—Leo P. Picard
*Assistant Examiner*—Trinidad Korka
*Attorney, Agent, or Firm*—Richard R. Mybeck

[57] ABSTRACT

A versatile unitary electrode splice cap for insulating and weatherproofing the splice connection between a neon tube electrode and its associated power cable in a neon sign system. The cap is useful both in "straight-on" and "double-back" installations.

10 Claims, 1 Drawing Sheet

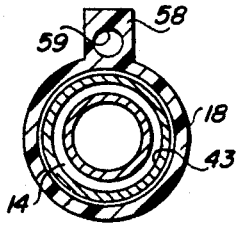
FIG. 4
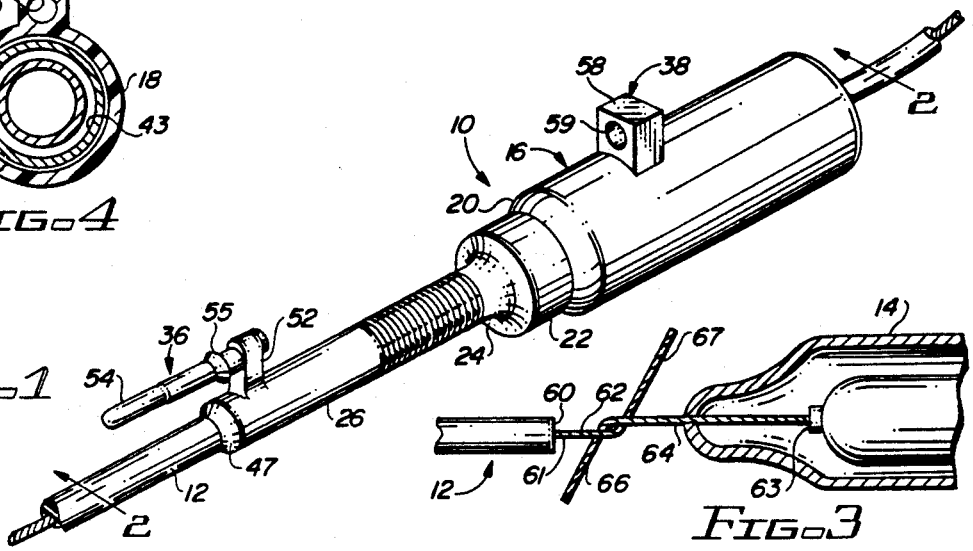
FIG. 1
FIG. 3
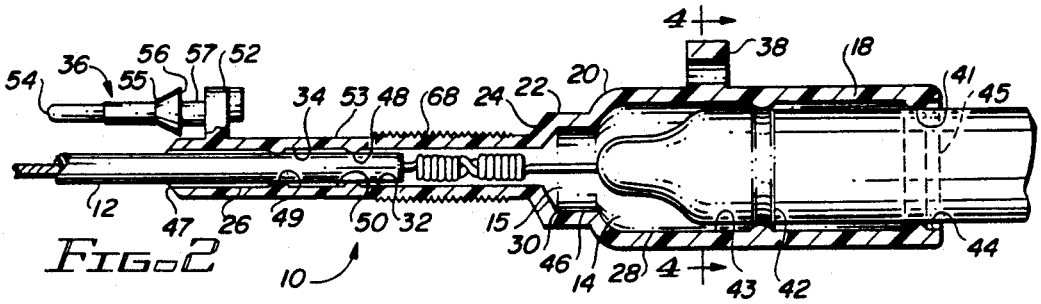
FIG. 2
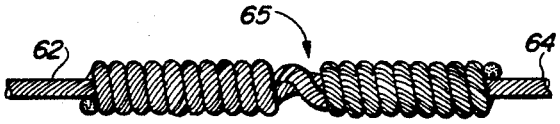
FIG. 3A
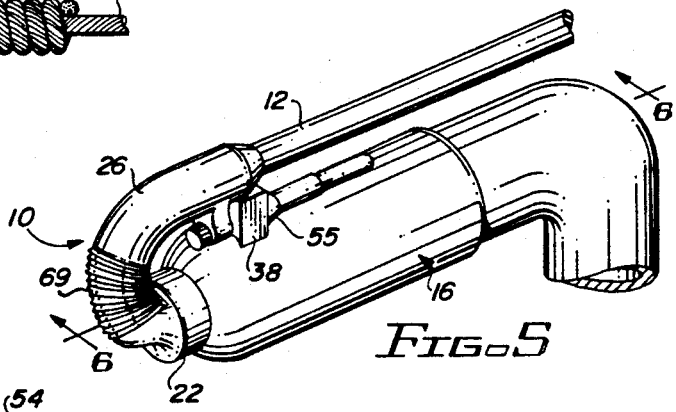
FIG. 5
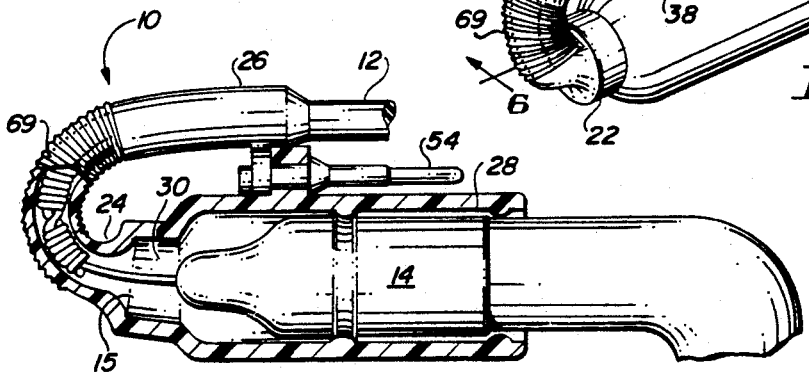
FIG. 6

WEATHERPROOF ELECTRODE SPLICE CAP FOR NEON SIGN SYSTEMS

The present invention relates generally to means for protecting neon electrodes when used in neon tube signage and more particularly to means for insulating and weatherproofing the splice connection between a standard neon tube electrode and the power cable associated therewith.

BACKGROUND OF THE INVENTION

A neon tube electrode, especially those used in modern advertising signs, often must be mounted outdoors where it is subject to a variety of adverse weather conditions. The electrical connection between each tube electrode and its associated power cable such as GTO cable, requires protection from moisture and other adverse components of the environment. If these connections are not properly covered, the useful life of the sign will decrease and hazardous shorts can occur which create a safety hazard at the site of such signage.

Another problem associated with the installation of outdoor electrical signs arises from close quarters which require that the power cable be doubled back over itself in order to complete a particular installation without "black spots" in the continuity of the message. Often such doubling back causes the insulating cover of the cable to crack whereupon the power cable becomes exposed and creates a potentially serious safety hazard.

The prior art proposed electrode housings to provide some measure of protection for splices used in the connection of neon tube electrodes to a power supply. However, such electrode housings can only be used in a limited number of situations and provide no substantial benefits to the installer when circumstances require a cable to be doubled back to assure continuity of the intended display.

Thus a need still exists for an electrode cap which is simple to install and which will provide a foolproof weatherproof cover for the spliced connection between a power cable and the neon tube electrode in the installation of neon signage. It is toward this need that the present disclosure is directed.

BRIEF SUMMARY OF THE DISCLOSURE

The present invention relates generally to means for providing an insulated, weatherproof sealed cover or cap for the spliced connection between GTO cable and neon tube electrodes required in the installation of outdoor or indoor neon tube signage.

More particularly, the present invention comprises a versatile weatherproof neon electrode device having an electrode body chamber, an electrode nose compartment, a splicing chamber, and a power cable chamber integrally formed in series within a unified structure and having locking means associated therewith which is selectively coactive with the device to provide security to the positioning of the power cable when the exigencies of installation require the cable to be doubled back.

Accordingly, it is the principal object of the present invention to provide a new and improved means for encasing and protecting the splice of a power cable to a neon tube electrode during the installation and operation of high voltage neon sign systems.

Another object of the present invention is to provide new and improved means for protecting neon electrodes which is simple to install and which has the versatility for use in both indoors and outdoors and with straight on or double back installations.

These and still further objects as shall hereinafter appear are fulfilled by the present invention in a remarkably unexpected fashion as can be readily discerned from a careful consideration of the following detailed description especially when read in conjunction with the accompanying drawing.

BRIEF DESCRIPTION OF THE DRAWINGS

FIG. 1 is an isometric view of a weatherproof neon tube electrode-power cable splice cap embodying the present invention;

FIG. 2 is a cross-section of the splice cap of FIG. 1 taken along line 2—2 thereof showing the splice retracted into the splice chamber thereof;

FIG. 3 is an enlarged breakaway view of the start of a splice between a wire braid extending from the power cable and a wire braid extending from the neon tube electrode;

FIG. 3A is an enlarged showing of a completed splice between the power cable braid and the neon tube electrode braid;

FIG. 4 is a cross-section of the splice cap of FIG. 1 taken on line 4—4 of FIG. 2;

FIG. 5 is an isometric view of a fully wired electrode cap in a "double back" installation in accordance with the present invention; and FIG. 6 is a cross-section of the electrode cap of FIG. 5 taken along line 6—6 thereof.

DETAILED DESCRIPTION OF PREFERRED EMBODIMENTS

The present invention relates generally to a new, unique and versatile weatherproof neon tube electrode splice cap for use to encase and protect a neon tube electrode, an associated power cable and the splice therebetween.

Referring to the drawing, a neon electrode splice cap embodying the present invention is identified by the general reference 10 and is operatively interposed between a power cable 12 and a neon tube electrode 14 having a nose 15 integrally formed therewith and extending axially therefrom which is formed in such a manner so as to allow the free and uninterrupted passage of a wire connected to electrode 14, therethrough in a manner to be hereinafter described in detail.

Each device 10 comprises an electrode receiving portion 16 having a first generally cylindrical body portion 18 and a tapered shoulder portion 20 terminating in a second cylindrical nose receiving portion 22 of lesser diameter than body portion 18. Extending outwardly from nose receiving portion 22 is a tapered transition portion 24 which interconnects nose receiving portion 22 with cable receiving portion 26.

As shown in FIG. 2, electrode receiving portion 16 defines a cylindrical electrode housing chamber 28 within body portion 18 and an electrode nose compartment 30 within nose receiving portion 22.

Cable receiving portion 26, as will hereinafter be described in greater detail, defines a splicing chamber 32 and a cable holding chamber 34 therewithin and supports latch member 36 thereupon. A latch locking means 38 is mounted on the exterior surface of electrode receiving portion 16 and extends radially therefrom. Each portion of device 10 will now be described in detail.

Electrode housing chamber 28 is defined by generally cylindrical body portion 18 which has a first and second sealing O-ring 41, 42 disposed in spaced generally parallel relationship to each other on the inner surface 43 of cylindrical body portion 18.

Body portion 18 defines an electrode receiving mouth 44 at the proximal end 45 thereof and on inwardly tapered annulus or shoulder 20 at the distal end 46 thereof which is integrally formed with nose receiving portion 22 to define electrode nose compartment 30 therein. Compartment 30 is likewise generally cylindrical about a central axis which coincides with an extension of the central axis of body portion 18.

To the distal side of nose compartment 30, tubular cable receiving portion 26 is integrally formed with transition portion 24 and extends axially therefrom to an end 47. A first sealing O-ring 48 and a second sealing O-ring 49 are disposed in spaced generally parallel relationship to each other on the inner surface 50 of tubular cable receiving portion 26 for a purpose to be hereinafter described in detail.

As shown in FIG. 2, O-ring 48 is positioned approximately in the middle of tubular portion 26 and O-ring 49 is disposed adjacent end 47. O-ring 48 in addition to its sealing coaction with power cable 12 as shown, further coacts with cable receiving portion 26 to define splicing chamber 32 and cable holding chamber 34.

Adjacent end 47 of tubular portion 26, latch member 36 is integrally formed with and extends axially from a pedestal member 52 which is integrally formed with and extends radially from the outer surface 53 of tubular member 26 at cable holding chamber 34. Latch member 36 comprises an elongated nose portion 54 and a frustoconical intermediate portion 55 which presents an annular base portion 56 for coacting with latch locking means 38 in a manner to be hereinafter described. A root member 57 is operatively interposed between and integrally formed with intermediate portion 55 and pedestal member 52 to secure latch member 36 to the outer surface 53 of cable receiving portion 26.

Latch locking means 38 as shown in FIGS. 2, 4, 5 and 6 comprises a body portion 58 extending radially from electrode housing chamber 28 and having a circular opening 59 defined axially therethrough with a diameter only slightly less than the outside diameter of annular base 56 of latch member 36.

In a preferred practice of the present invention, electrode cap 10 will be injection molded from an ALCRYN-HYTREL blend plastic obtained from E.I. Dupont Co. Wilmington Delaware. ALCRYN-HYTREL has been found to have all of the attributes desired herein. Thus, ALCRYN-HYTREL blend provides a cured product which is flexible, waterproof, is an electrical insulator with dielectric properties, a flame retardance rating of 94– 5V and is capable of retaining these properties over a wide range of operating temperatures. Other plastics having similar properties may be employed herein when desired.

It should be further noted that, in practice, device 10 is readily adjusted to accommodate all of the neon tube electrodes currently approved for use in the sign industry by the simple expediency of varying the inside diameter of chamber 28 between 10 mm and 18 mm thereby insuring a tight sealing engagement with each electrode 14. Similar variation is not required for tubular portion member 26 since the power cables 12 in approved use today, such as GTO cable, are standardized between 0.217 and 0.243 inch.

As shown in FIG. 2, when wired for use, electrode housing chamber 28 will receive and encase the nose of the neon tube electrode 14 in such a manner that body portion 10 fits snugly around electrode 14 and O-rings 41, 42 assure a weatherproof and waterproof seal between the electrode chamber 28 and the neon tube electrode 14 inserted thereinto. Rings 41, 42 in addition provide a friction lock between chamber 28 and tube electrode 14 to further secure electrode 14 in its place.

Cable holding chamber 34 receives and encases a portion of the power cable 12 delivering power to the neon tube electrode 14. The inner surface 50 of tubular member 26 in chamber 34 creates a snug fit around cable 12 while O-rings 48, 49 decrease the inside diameter of surface 50 and provide a snug weatherproof seal with power cable 12 and accordingly protects the connection between power cable 12 and electrode 14 as will hereinafter be described.

In practice, power cable 12 will be drawn through device 10 until a workable portion of cable 12 extends beyond mouth 44 of chamber 28 as shown in FIG. 1. Cable 12 is then stripped of insulation 60 for about 1–2 inches to expose the wires 61 contained therein. The cable wires are then twisted into a single strand 62. Next, the wires 63 extending from electrode 14 are likewise twisted into a single strand 64.

The strand 62 from cable 12 and the strand 64 from electrode 14 which passes through nose 15 then crossed and joined together as shown in FIG. 3 and finished by winding to form splice 65. A highly favorable method for completing splice 65 involves use of the so-called "Western Union" or "Loneman's" splice, as shown in FIG. 3A. After the strands 62, 64 are crossed, one of the resultant tails 66 is coiled in a clockwise direction while the other tail 67 is coiled in a counter-clockwise direction thereby rendering it virtually impossible to unintentionally disconnect the strands 62, 64 from within splice 65.

When the respective strands 62, 64 are thus combined into splice 65, electrode 14 is securely wired to power cable 12. Next, cable 12 is drawn back toward end 47 of tubular member 26 until electrode 14 is seated in electrode chamber 28 and electrode nose 15 is securely seated in compartment 30 as shown in FIG. 2. Splice 65, created in any suitable fashion such as that described, is drawn back into splicing chamber 32 and cable 12 is disposed in cable chamber 34 where it is sealingly secured by the coaction of O-rings 48, 49 thereupon. Thus, neon tube electrode 14 is properly wired and seated in splice cap 10 and is ready for activation just as soon as the remaining electrodes in the particular display are similarly installed.

In the preferred practice of the present invention, that portion of surface 53 circumscribing splice chamber 32 is scored with a plurality of circular groves 68 disposed in concentric relationship to tubular member 26 in spaced generally parallel relationship to each other to create a flexible portion 69 in the otherwise semi-rigid tubular member 26 for a purpose to be described. In one embodiment, fifteen or more of such rings are defined in axially spaced generally parallel relationship to each other along about one-half of the entire length of tubular member 26, although this number can be varied if desired to conform to the exigencies of a particular installation. Flexible portion 69 will always coincide with splicing chamber 32 which permits device 10 to be flexed or folded in a manner convenient to secure latch member 36 in latch locking means 38 while maintaining a waterproof seal for the cable 12, the electrode 14 and the splice 65 at all times as shown in FIGS. 5 and 6.

As previously described, latch locking means 38 is molded with body portion 18 and extends radially therefrom, preferably in the shape of a square block 58 having opening 59 defined therethrough in longitudinally aligned relationship to nose 54 of latch member 36.

Thus, when a double-back installation is required as shown in FIGS. 5 and 6, cable 12 is folded back at the hinge-like mechanism provided by flexible portion 69 until the nose portion 54 is aligned with opening 59 and then pressed therethrough until frustoconical portion 55 passes through opening 59 and annular base 56 bears upon body portion 58 to lock latch member 36 in place and prevent its withdrawal therefrom.

As shown in FIGS. 1 and 2, latch member 38 is molded with a spaced offset relationship to cable holding chamber 34 so that root member 57 is disposed adjacent the leading edge 47 of tubular member 26 and nose portion 54, intermediate portion 55 and root member 57 extend therebeyond.

Thus described and illustrated, the neon electrode splice cap 10 of the present invention provides a secure, electrically insulated, weatherproof cap for splicing a neon tube electrode 14 to a power cable 12 as well as a weatherproof, electrically insulated secure means for attaching power cable 12 such as GTO cable to a neon tube electrode 14 when a double-back installation is required or desired.

From the foregoing, it becomes apparent that new and useful procedures have been herein described and illustrated which fulfill all of the aforestated objectives in a remarkably unexpected fashion. It is of course understood that such modifications, alterations and adaptations as may readily occur to an artisan having the ordinary skills to which this invention pertains are intended within the spirit of the present invention which is limited only by the scope of the claims appended hereto.

What is claimed is:

1. A weatherproof electrode splice cap comprising: a first cylindrical body portion having a mouth at one end thereof for receiving a neon tube electrode therein having a nose extending axially therefrom; a second cylindrical body portion having a lesser diameter than said first cylindrical body portion for engaging said nose of said electrode; an annular shoulder portion operatively interposed between said first cylindrical body portion and said second cylindrical body portion; and a third cylindrical body portion extending axially from said second cylindrical body portion and having a lesser diameter than said second portion cylindrical body portion for circumscribing a power cable in watertight sealing relationship thereto and holding said power cable in fixed space relationship to said nose of said electrode, said third cylindrical body portion enclosing a cable holding chamber and a splice chamber and having a plurality of spaced parallel grooves defined in the outer surface thereof in circumscription about said splice chamber.

2. For use in connecting a neon tube electrode to a power cable in a high voltage neon sign system, a weatherproof electrode splice cap comprising: a first cylindrical body portion having a mouth at one end thereof for receiving a neon tube electrode therein said electrode having a nose extending axially therefrom; a second cylindrical body portion having a lesser diameter than said first cylindrical body portion for engaging in circumscription thereabout the nose of said electrode; an annular shoulder portion operatively interposed between said first cylindrical body portion and said second cylindrical body portion; a third cylindrical body portion extending axially from said second cylindrical body portion and having a lesser diameter than said second cylindrical body portion for circumscribing a power cable in watertight sealing relationship thereto; and latching means for securing said third cylindrical body portion to said first cylindrical body portion when said third cylindrical body portion is doubled back over said first cylindrical body portion.

3. A weatherproof electrode splice cap according to claim 2 in which said latching means comprises a latch member secured to said third cylindrical body portion and a latch locking member secured to said first cylindrical body portion.

4. A weatherproof electrode splice cap according to claim 3 in which said latch member comprises a pedestal member integrally formed with said third cylindrical body portion and extending axially therefrom, an elongated nose portion, a root portion, and an intermediate portion operatively interposed between said root portion and said nose portion and having ann annular surface defined thereupon for locking engagement with said latch locking member.

5. A weatherproof electrode splice cap according to claim 4 in which said latch locking member comprises a body portion integrally formed with and extending outwardly from said first cylindrical body portion and a central opening defined through said body portion in spaced parallel relationship to said first cylindrical body portion and adapted to receive said elongated nose portion and said intermediate portion therethrough and engage said annular surface with said body portion.

6. A weatherproof electrode splice cap according to claim 1 in which said first cylindrical body portion has first and second watertight sealing means disposed therewithin in spaced generally parallel relationship to each other.

7. A weatherproof electrode splice cap according to claim 3 in which said first cylindrical body portion has first and second watertight sealing means disposed therewithin in spaced generally parallel relationship to each other.

8. A weatherproof electrode splice cap according to claim 6 in which said third cylindrical body portion has first and second watertight sealing means disposed therewithin in spaced generally parallel relationship to each other.

9. A weatherproof electrode splice cap according to claim 7 in which said third cylindrical body portion has first and second watertight sealing means disposed therewithin in spaced generally parallel relationship to each other.

10. A high voltage neon sign system comprising a neon tube, a neon tube electrode integrally formed with said neon tube, a selective actuatable power cable disposed in spaced operative juxtaposition with said neon tube electrode and spliced thereto; a weatherproof electrode splice cap operatively disposed about said electrode, said splice and an adjacent portion of said power cable in sealing weatherproof relationship therewith; and latching means operable to secure one portion of said splice cap to another portion of said splice cap when said one portion is doubled back over said other portion.

* * * * *